US011254118B2

(12) United States Patent
Praharaj et al.

(10) Patent No.: US 11,254,118 B2
(45) Date of Patent: Feb. 22, 2022

(54) APPARATUS FOR INK CONTAMINANT DRYING

(71) Applicant: Xerox Corporation, Norwalk, CT (US)

(72) Inventors: Seemit Praharaj, Webster, NY (US); Paul McConville, Webster, NY (US); Douglas Herrmann, Webster, NY (US); Jason Lefevre, Penfield, NY (US); Chu-Heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 80 days.

(21) Appl. No.: 16/246,734

(22) Filed: Jan. 14, 2019

(65) Prior Publication Data

US 2020/0223219 A1 Jul. 16, 2020

(51) Int. Cl.
*B41F 22/00* (2006.01)

(52) U.S. Cl.
CPC ..... *B41F 22/00* (2013.01)

(58) Field of Classification Search
CPC ..... B41F 22/00
USPC ..... 101/487
See application file for complete search history.

(56) References Cited

U.S. PATENT DOCUMENTS 5,510,822 A * 4/1996 Vincent ..... B41J 2/2103 219/216
5,526,028 A 6/1996 Rottman
5,554,413 A * 9/1996 Nikaido ..... B29C 43/222 427/108
5,717,446 A 2/1998 Teumer et al.
5,863,140 A 1/1999 DeMarchi
6,116,728 A * 9/2000 Miyake ..... B41J 11/002 347/102
6,280,014 B1 8/2001 Sharma et al.
6,347,858 B1 2/2002 Faisst, Jr. et al.
6,364,443 B1 4/2002 Katano et al.
6,367,905 B1 4/2002 Sharma et al.
6,394,596 B1 * 5/2002 Wotton ..... B41J 11/007 226/172
6,698,878 B1 * 3/2004 Roche ..... B41J 11/007 134/9
7,270,494 B2 9/2007 Silverbrook et al.
7,475,973 B2 * 1/2009 Kruijt ..... B41J 11/0015 347/104
7,976,118 B2 7/2011 Fairchild et al.
8,100,398 B2 1/2012 Brock
10,160,239 B2 12/2018 Chen et al.
(Continued)

OTHER PUBLICATIONS

Xerox® Brenva® HD Production Inkjet Press, 2018 Xerox Corporation.

(Continued)

*Primary Examiner* — Anthony H Nguyen
(74) *Attorney, Agent, or Firm* — Ortiz & Lopez, PLLC; Kermit D. Lopez; Luis M. Ortiz

(57) ABSTRACT

An apparatus for ink contaminant drying includes a marker platen having a topside and a bottom side, and a plurality of heating elements located beneath the topside of the marker platen. The plurality of heating elements provides heating with respect to a surface of the marker platen, which prevents ink contaminants on the surface from remaining in a viscous fluidic state over a period of time.

20 Claims, 6 Drawing Sheets

(56) References Cited

U.S. PATENT DOCUMENTS

| | | | | |
|---|---|---|---|---|
| 2002/0071016 | A1* | 6/2002 | Wotton | B41J 11/0085 347/102 |
| 2002/0108719 | A1* | 8/2002 | Cullins | B29C 66/45 156/583.91 |
| 2008/0011171 | A1* | 1/2008 | Schneider | B41F 33/0045 101/350.1 |
| 2008/0024557 | A1* | 1/2008 | Moynihan | B41J 11/06 347/56 |
| 2017/0090461 | A1 | 3/2017 | Chong et al. | |

OTHER PUBLICATIONS

"Why does moisture sometimes seem to cause MORE friction?", quora.com, downloaded Dec. 10, 2018.
SheetFeeder BV, Jet speed productivity, 2018 Tecnau.
Xerox® Brenva™ HD Production Inkjet Press Overview, 2016 Xerox Corporation.

* cited by examiner

APPARATUS FOR INK CONTAMINANT DRYING

TECHNICAL FIELD

Embodiments are generally related to printing systems. Embodiments also relate to transports and transport members utilized in printing systems. Embodiments are additionally related to cartridge heating elements for ink contaminant drying in print systems.

BACKGROUND

Printing systems known in the document reproduction arts can apply a marking material, such as an ink or a toner, onto a substrate such as a sheet of paper, a textile, metal, plastic and objects having a non-negligible depth such as a coffee cup, bottle, and the like.

A printing system can perform printing of an image or the like on sheets of paper, for example, by transporting a sheet of paper (or other substrates), which is an example of a medium, up to a position of a printing section using a transport roller, and an "endless" form transport belt, which can rotate while coming into contact with the sheet of paper, and discharging ink, which is an example of a liquid, toward the sheet of paper from a liquid discharging head. A transport roller, a transport belt, and so on, are examples of transport members. When ink, which is discharged from the liquid discharging head, becomes attached to the outer surface of the transport belt, there is a concern that the ink may be transferred to sheets of paper that are transported by the transport belt, and that the sheets of paper can become stained.

In some printing systems, a particular type of transport or transport member, known as a marker transport, can become contaminated with aqueous ink, which can lead to an increase in frictional drag, and a loss of drive capacity and image quality (e.g., pixel placement) degradation. To prevent contamination from reaching undesirable levels, a periodic belt-cleaning interval of one week, for example, and an even more extensive cleaning (e.g., ~250 Kp) may be needed and can require a skilled/trained operator for the printing system. This type of cleaning is currently difficult to accomplish in some printing systems (e.g., ~20" cross-process width) and the additional width associated with such systems (e.g., ~32" cross-process width) can make this work even more difficult and time consuming with additional risk to damaging the transport belt. Some printing systems may include a market transport sub-system located near the floor, for example, and may require the operator to kneel or lay on the floor during cleaning. A 20" width, for example, may be the widest transport that can be reasonably cleaned manually by anyone of typical arm length and dexterity.

During extensive cleaning operations, the transport belt (e.g., a market transport belt) may need to be removed from the transport (e.g., a marker transport) to be cleaned. The transport belt may be configured from a very thin plastic material, which can become creased or ripped or damaged during removal or reinstallation. The transport belt may need to remain in a pristine undamaged condition to maintain the very tight (e.g., 1 mm) printing gaps, which may be needed for acceptable image quality.

BRIEF SUMMARY

The following summary is provided to facilitate an understanding of some of the features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an apparatus, system and method for ink contaminant drying.

It is another aspect of the disclosed embodiments to provide for an apparatus, system and method for ink contaminant drying that includes a group of heating elements located beneath the topside of one or more marker platen surface guides.

If is a further aspect of the disclosed embodiments to provide for ink contaminant drying that can be incorporated into a printing system.

The aforementioned aspects and other objectives and advantages can now be achieved as described herein. An apparatus, system and method for ink contaminant drying are disclosed, which can include a marker platen having a topside and a bottom side, and a plurality of heating elements located beneath the topside of the marker platen, wherein the plurality of heating elements provides heating with respect to a surface of the marker platen, which prevents ink contaminants on the surface from remaining in a viscous fluidic state over a period of time.

In an embodiment, a series of heating elements can be located beneath topside marker platen surface guides. The frictional drag between the marker platen can be reduced significantly when the ink contaminants are dried. The series of heating elements strategically located below the platen guides can provide for heating to the surface of the guides. Consequently, the ink contaminants that land on the platen surface may be unable to remain in a highly viscous fluidic state for any significant amount of time. In a solid state, the ink contaminants may be unable to give rise to any frictional drag, in most cases simply "flaking off" from the active surfaces due to the motion of the transport belt.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
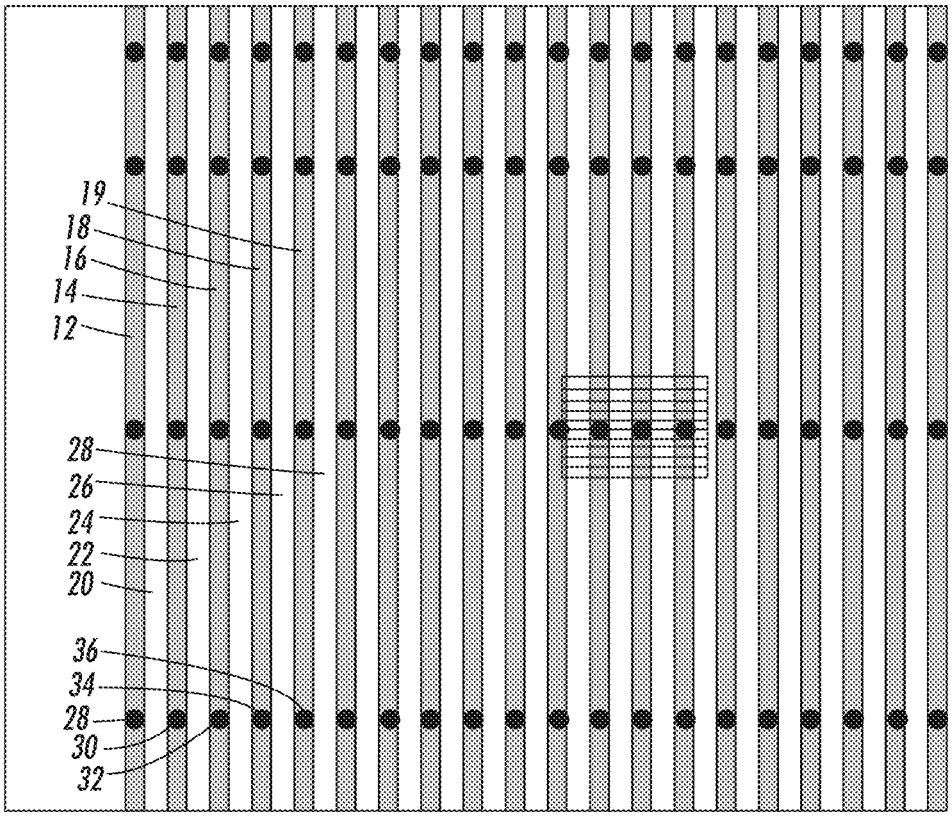
FIG. 1 illustrates a screen shot of the top view of a marker platen, in accordance with an embodiment.

The particular values and configurations discussed in these non-limiting examples can be varied and are cited merely to illustrate one or more embodiments and are not intended to limit the scope thereof.

Subject matter will now be described more fully herein after with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems/devices. Accordingly, embodiments may, for example, take the form of hardware, software, firmware or any combination thereof (other than software per se). The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein do not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms, such as "and", "or", or "and/or" as used herein may include a variety of meanings that may depend, at least in part, upon the context in which such terms are used. The term "or" if used to associate a list, such as A, B, or C, may be intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a", "an", or "the", again, may be understood to convey a singular usage or to convey a plural usage, depending at least in part upon the context. In addition, the term "based on" may be understood as not necessarily intended to convey an exclusive set of factors and may, instead, allow for existence of additional factors not necessarily expressly described, again, depending at least in part on context. Additionally, the term "step" can be utilized interchangeably with "instruction" or "operation".

Unless defined otherwise, all technical and scientific terms used herein have the same meanings as commonly understood by one of ordinary skill in the art. As used in this document, the term "comprising" means "including, but not limited to."

Figure 7:
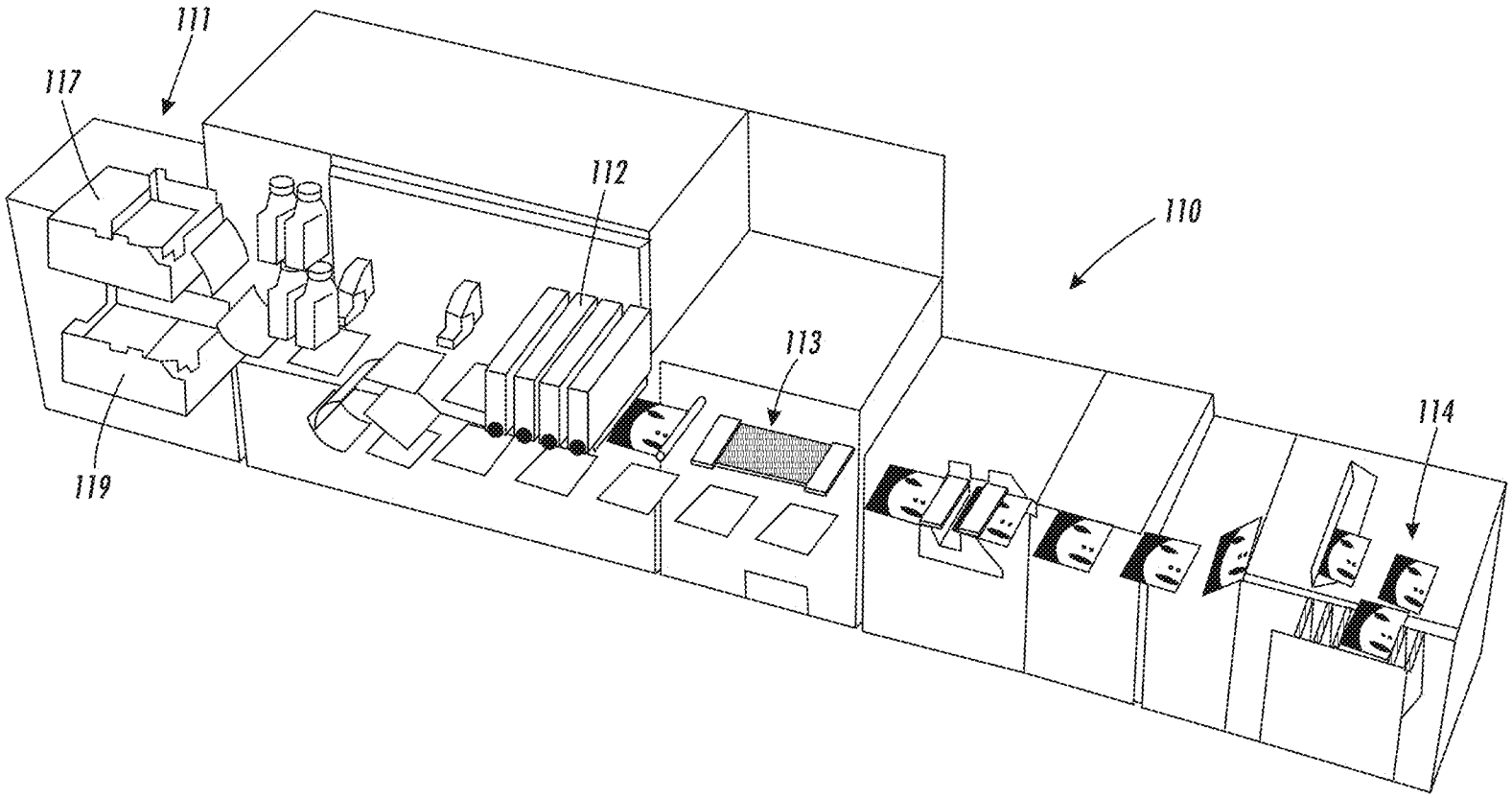
FIG. 7 illustrates a pictorial diagram depicting an example printing system in which an embodiment may be implemented.

The term "printing system" as utilized herein can relate to a printer, including digital printing devices and systems that accept text and graphic output from a computing device, electronic device or data processing system and transfers the information to a substrate (e.g., paper, cloth, metal, etc) usually to standard size sheets of paper. A printing system may vary in size, speed, sophistication, and cost. In general, more expensive printers are used for higher-resolution printing. A printing system can render images on print media (e.g., paper or other substrates), and can be a copier, laser printer, bookmaking machine, facsimile, or a multifunction machine (which can include one or more functions such as scanning, printing, archiving, emailing, faxing and so on). An example of a printing system that can be adapted for use with one or more embodiments is shown in FIG. 7.

The term "transport belt" as utilized herein can relate to a belt implemented in a printing system in association in with a rotatable member (e.g., a roller or other transport members or web transport configurations). The term "transport belt" can relate to a marking transport or a marker transport, which may become contaminated with aqueous ink. To permit a high registration accuracy, a printing system can employ such a transport belt, which in some implementations can pass in front of toner cartridges and each of the toner layers can be precisely applied to the transport belt. The combined layers can be then applied to the paper in a uniform single step. It should be appreciated, however, that the disclosed embodiments are not limited to printers that utilize toner. Ink and other types of marking media may be utilized in other printing embodiments. That is, a printing system is not limited to a laser printing implementation but may be realized in other contexts (e.g., ink-jet printing systems).

A "computing device" or "electronic device" or "data processing system" refers to a device or system that includes a processor and non-transitory, computer-readable memory. The memory may contain programming instructions that, when executed by the processor, cause the computing device to perform one or more operations according to the programming instructions. As used in this description, a "computing device" or "electronic device" may be a single device, or any number of devices having one or more processors that communicate with each other and share data and/or instructions. Examples of computing devices or electronic devices include, without limitation, personal computers, servers, mainframes, gaming systems, televisions, portable electronic devices include smartphones, personal digital assistants, cameras, tablet computers, laptop computers, and media players.

FIG. 1 illustrates a screen shot of the top view of a marker platen 10, in accordance with an embodiment. As shown in FIG. 1 the marker platen 10 can include a vacuum channel 12, a vacuum channel 12, a vacuum channel 14, a vacuum channel 16, a vacuum channel 18, and a vacuum channel 19. The marker platen 10 can further include one or more landing areas including a landing area 20, a landing area 22, a landing area 24, a landing area 26, and a landing area 28, and so on where a transport belt 39 (shown in FIG. 2) can ride. The marker platen 10 can also include one or more vacuum ports including a vacuum port 28, a vacuum port 30, a vacuum port 32, a vacuum port 34, and a vacuum port 36, and so on, which can feed the vacuum channel 12, the vacuum channel 14, the vacuum channel 16, the vacuum channel 18, the vacuum channel 19 and so on. It can be appreciated that additional or fewer vacuum channels, landing areas and vacuum ports can be implemented, and that any specific number of such vacuum channels, landing areas and vacuum ports are not limiting features of the disclosed embodiments. FIG. 1 thus illustrates strategic areas of interest in a marker transport.

Figure 2:
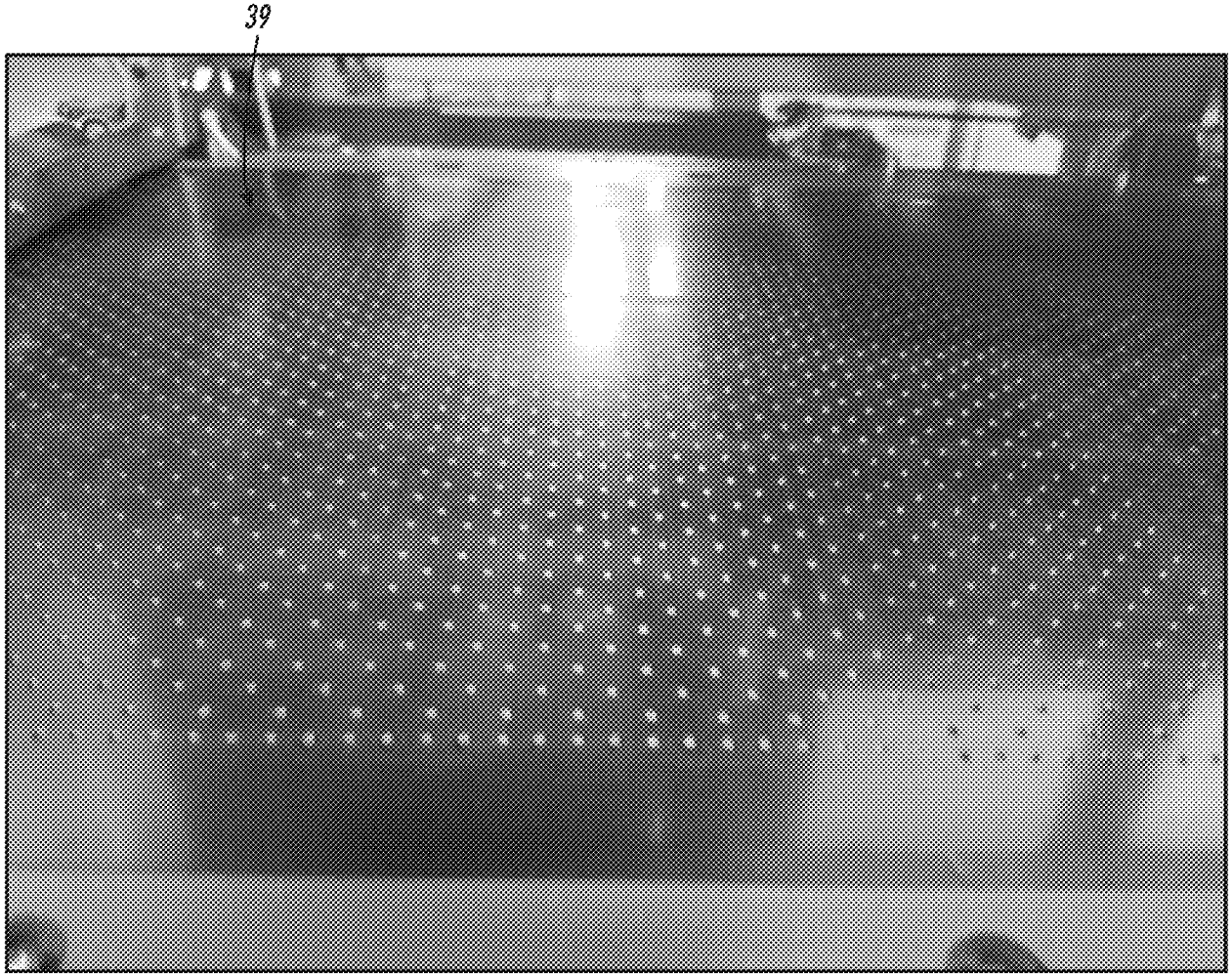
FIG. 2 illustrates a screen shot of a transport belt, in accordance with an embodiment.

FIG. 2 illustrates a screen shot of a transport belt 39, in accordance with an embodiment. The marker transport belt 39 can ride on top of the marker platen 10, and can be configured with vacuum holes spaced periodically, and which can be aligned with the vacuum channels.

Figure 3:
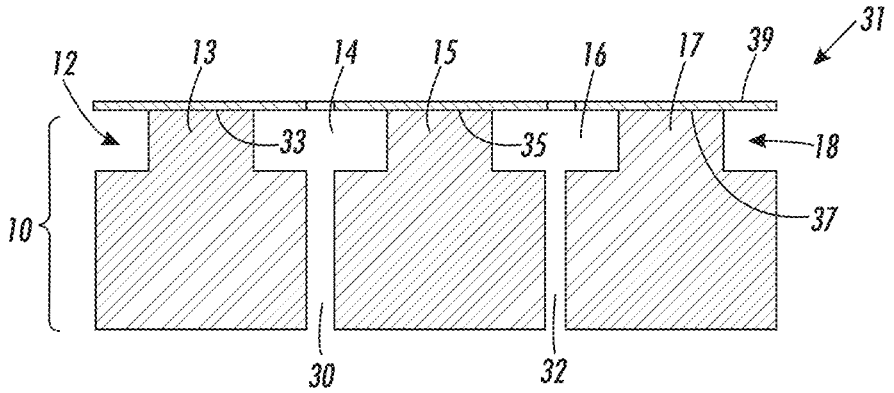
FIG. 3 illustrates a block diagram depicting a side sectional view of an apparatus that includes the marker platen and the transport belt, in accordance with an embodiment.

FIG. 3 illustrates a block diagram depicting a side sectional view of an apparatus 31 that includes the marker platen 10 and the transport belt 39, in accordance with an embodiment. It can be appreciated that the apparatus 31 can be incorporated into a printing system. As shown in FIG. 3, the vacuum channel 12, the vacuum channel 14, the vacuum channel 16, the vacuum channel 18, and the vacuum channel 19 can be disposed below the transport belt 39. The apparatus 31 can include one or more guides including a topside marker platen surface guide 13, a topside marker platen surface guide 15, and a topside marker platen surface guide 17.

An ink contamination area 33, an ink contamination area 35, and an ink contamination area 37 may be located on the transport belt 39 or at the top surface of the guide 13, the guide 15, and the guide 17, as shown in FIG. 3. A vacuum port 30 and a vacuum port 32 are also shown in FIG. 3 with respect to the vacuum channel 14 and the vacuum channel 16. The contact area between the marker transport belt 39 and the marker platen 10 may be the area most likely to suffer from ink contamination resulting in excessive frictional drag.

The drag force on the marker platen 10, when contaminated with ink such as in the ink contamination area 33, the ink contamination area 35, and the ink contamination area 37 may follow a 'shark-fin' type trajectory with respect to ink contaminant drying. When the ink contaminant is freshly dispersed from the print head (not shown) of the printing system and onto the platen surface, it is likely in a low viscosity fluidic state. As a result the consequent drag force between the marker transport belt 39 and the marker platen 10 may be minimal.

As this ink contaminant experiences drying over an extended period of time, the water content in it decreases while the concentration of co-solvents and other high boiling additives (e.g. glycols) remains constant. Consequently, the ink contaminant may be more likely to behave like a high viscosity fluid during these times. Such circumstances can increase the drag force between the belt and the platen and may lead to drive force failure.

Figure 4:
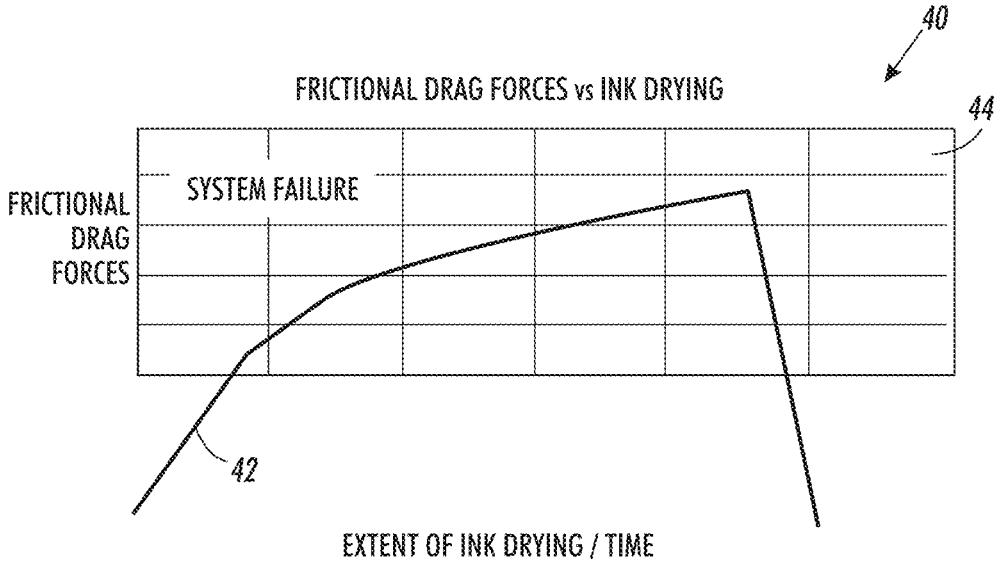
FIG. 4 illustrates a graph depicting a plot of frictional drag forces versus ink drying, in accordance with an embodiment.

FIG. 4 illustrates a graph 40 depicting a plot 42 of frictional drag forces versus ink drying, in accordance with an embodiment. FIG. 4 demonstrates the variation of the frictional drag force with the extent of ink drying. The zone 44 shown in graph 40 is indicative of where the frictional drag forces may be so high that a drive force failure may result. Ideally, the transport belt 39 should be operated in the non-red zones for a smooth motion quality.

Under a normal operating condition (e.g., near ambient conditions), the ink contaminants may dry over a significantly long period of time. As a result, the contaminants may spend a great deal of time in zone 44 as graph 40 demonstrates. If, however, external heating is provided with respect to the contaminants, this can greatly reduce the time spent in zone 44. It should be noted that the more time the contaminant spends in the zone 44, the more susceptible the transport belt 39 may be to experiencing a drag-induced failure.

Figure 5:
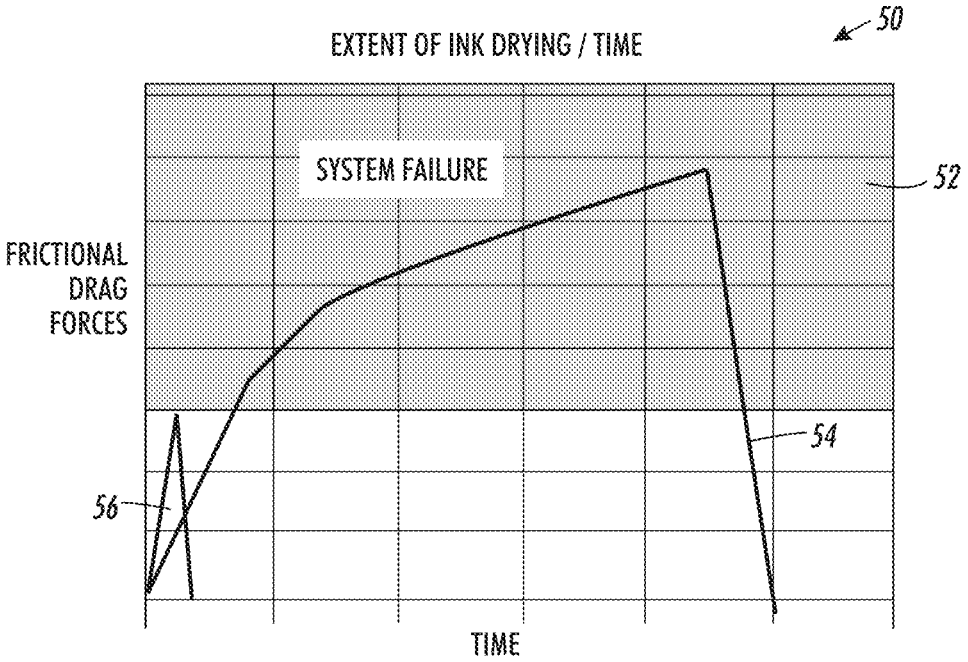
FIG. 5 illustrates a graph depicting plots of frictional drag forces versus ink drying including ambient drying and external drying, in accordance with an embodiment.

FIG. 5 illustrates a graph 50 depicting plots of frictional drag forces versus ink drying including ambient drying and external drying, in accordance with an embodiment. FIG. 5 demonstrates cases with and without external heating. As shown in FIG. 5, a plot line 52 represents ambient drying and a plot line 56 represents external drying. It can therefore be concluded from graph 50 of FIG. 5 that heating the ink contaminants can be a viable strategy for reducing the frictional drag forces between the marker transport belt 39 and the marker platen 10 (including platen guides).

Figure 6:
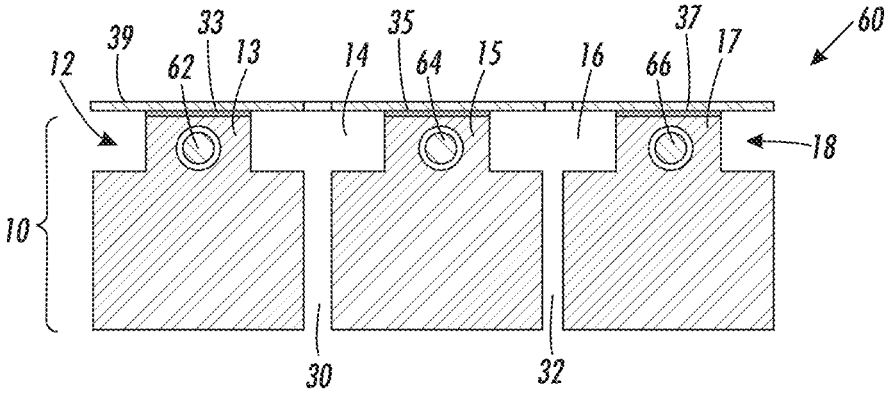
FIG. 6 illustrates a block diagram depicting a side sectional view of an apparatus for ink contaminant drying, in accordance with an embodiment.

FIG. 6 illustrates a block diagram depicting a side sectional view of an apparatus 60 for ink contaminant drying, in accordance with an embodiment. Note that in FIG. 3 and FIG. 5, similar or identical parts or elements are indicated by identical reference numerals. The apparatus 60 includes a group of heating elements 62, 64, and 66, which can be strategically placed inside the guides of the marker platen 10. FIG. 6 thus shows a sectioned view of the marker platen 10 with heating elements 62, 64, and 66 respectively located with the topside marker platen surface guide 13, the topside marker platen surface guide 15, and the topside marker platen surface guide 17.

The heating element 62, the heating element 64, and the heating element 66 can be placed in close proximity to the areas with the highest probability of ink contamination, which can result in a very efficient transfer of energy in order to dry out the ink contaminants. Stainless steel (e.g. material of construction of the marker platen) being a good conductor of heat can quickly and efficiently transfers the heat to the ink contaminants. Once dry, the motion of the transport belt 39 can dislodge the ink contaminant "flakes".

Note that the topside marker platen surface guide 13, the topside marker platen surface guide 15, and the topside marker platen surface guide 17 on the marker platen 10 may need to be hollowed out and small heating elements placed therein. That is, compact versions of heating element 62, the heating element 64, and the heating element 66 may be placed within respective topside marker platen surface guide 13, the topside marker platen surface guide 15, and the topside marker platen surface guide 17

The majority of the cost associated with an upgrade may result from the cost of the heating elements. Typically the boiling points of the glycols are about 200 C, hence, a target temperature rate of 200 C-250 C may be deemed most appropriate. Cartridge heating elements due to their shape and size are an ideal choice for the heating element 62, the heating element 64, and the heating element 66.

The apparatus 60 thus can incorporate a series of heating elements including the heating element 62, the heating element 64, the heating element 66, etc., which can be located beneath the topside marker platen surface guide 13, the topside marker platen surface guide 15, the topside marker platen surface guide 17, etc. The frictional drag between the marker platen 10 can be reduced significantly when the ink contaminants are dried. The heating element 62, the heating element 64, and the heating element 66 can be strategically located below the platen guides to provide heating to the surface of the guides. Consequently, the ink contaminants that land on the platen surface may be unable to remain in a highly viscous fluidic state for any significant amount of time. In a solid state the ink contaminants may be unable to give rise to any frictional drag, in most cases simply "flaking off" from the active surfaces due to the belt motion.

A continuous operation of the heating element 62, the heating element 64, and the heating element 66 may not be advisable as this may result in an elevated temperature in the system during operation. A number of catastrophic impacts on the system may result such as rapid print head drying, increased curl and cockle in the media amongst other possible impacts. Therefore, an ideal operation procedure for the heating elements 62, 64, 66 should be during system idle times. System idle times usually occur when the print heads are capped and no printing takes place. The heating elements 62, 64, 66 exercised during this time period may minimize or may reduce the effects on the remainder of the system. The time of operation can be determined based on a heating capability and the ink drying characteristics. This can be adjusted to operate on a time scale of, for example, ~10 minutes. Such features can allow, in most cases, for the system to return to an ambient temperature before resuming operation.

FIG. 7 illustrates a pictorial diagram depicting an example printing system 110 in which an embodiment may be implemented. That is, the apparatus 60 shown in FIG. 6, for example, can be implemented in the printing system 110. In some embodiments, the printing system 110 can be implemented as an aqueous inkjet printer. The printing system 110 shown in FIG. 7 can include a number of sections or modules, such as, for example, a sheet feed module 111, a print head and ink assembly module 112, a dryer module 113 and a production stacker 114. Such modules can be composed of physical hardware components, but in some cases may include the use of software or may be subject to software instructions.

It should be appreciated that the printing system 110 depicted in FIG. 7 represents one example of an aqueous inkjet printer that can be adapted for use with one or more embodiments. The particular configuration and features shown in FIG. 7 should not be considered limiting features of the disclosed embodiments. That is, other types of printers can be implemented in accordance with different embodiments. For example, the printing system 110 depicted in FIG. 7 can be configured as a printer that uses water-based inks or solvent-based inks, or in some cases may utilize toner ink in the context of a LaserJet printing embodiment.

In an embodiment, the sheet feed module 111 of the printing system 110 can be configured to hold, for example, 2,500 sheets of 90 gsm, 4.0 caliper stock in each of two trays. With 5,000 sheets per unit and up to 4 possible feeders in such a configuration, 20,000 sheets of non-stop production activity can be facilitated by the printing system 110. The sheet feed module can include an upper tray 17 that holds, for example, paper sizes 8.27"×10"/210 mm×254 mm to 14.33"×20.5"/364 mm×521 mm, while a lower tray 19 can hold paper sizes ranging from, for example, 7"×10"/178 mm×254 mm to 14.33"×20.5"/364 mm×521 mm. Each feeder can utilize a shuttle vacuum feed head to pick a sheet off the top of the stack and deliver it to a transport mechanism.

The print head and ink assembly module 112 of the printing system 110 can include, for example a plurality of inkjet print heads that deliver four different drop sizes through, for example, 7,870 nozzles per color to produce prints with, for example, a 600×600 dpi. An integrated full-width scanner can enable automated print head adjustments, missing jet correction and image-on-paper registration. Operators can make image quality improvements for special jobs such as edge enhancement, trapping, and black overprint. At all times automated checks and preventative measures can maintain the press in a ready state and operational.

The dryer module 113 of the printing system 110 can include a dryer. After printing, the sheets can move directly into a dryer where the paper and ink are heated with seven infrared carbon lamps to about 90° C. (194° F.). This process removes moisture from the paper so the sheets are stiff enough to move efficiently through the paper path. The drying process also removes moisture from the ink to prevent it from rubbing off. A combination of sensors, thermostats, thermistors, thermopiles, and blowers accurately heat these fast-moving sheets, and maintain rated print speed.

The production stacker 114 can include a finisher that can run over a period of time as it delivers up to 2,850 sheets at a time. Once unloaded, the stack tray can return to a main stack area to pick and deliver another load. The stacker 114 can provide an adjustable waist-height for unloading from, for example, 8" to 24", and a by-pass path with the ability to rotate sheets to downstream devices. The production stacker 14 can also be configured with, for example, a 250-sheet top tray for sheet purge and samples, and can further include an optional production media cart to ease stack transport. One non-limiting example of printing system 110 is the Xerox® Brenva® HD Production Inkjet Press, a printing product of Xerox Corporation. Such a printing system can include transport members such as the transport belts discussed herein and/or other features including for example a Brenva®/Fervent® marking transport, which is also a product of Xerox Corporation.

As can be appreciated by one skilled in the art, embodiments can be implemented in the context of a method, data processing system, or computer program product. Accordingly, embodiments may take the form of an entirely hardware embodiment, an entirely software embodiment or an embodiment combining software and hardware aspects all generally referred to herein as a "circuit" or "module." Furthermore, embodiments may in some cases take the form of a computer program product on a computer-usable storage medium having computer-usable program code embodied in the medium. Any suitable computer readable medium may be utilized including hard disks, USB Flash Drives, DVDs, CD-ROMs, optical storage devices, magnetic storage devices, server storage, databases, etc.

Computer program code for carrying out operations of the present invention may be written in an object oriented programming language (e.g., Java, C++, etc.). The computer program code, however, for carrying out operations of particular embodiments may also be written in procedural programming languages, such as the "C" programming language or in a visually oriented programming environment, such as, for example, Visual Basic.

The program code may execute entirely on the user's computer, partly on the user's computer, as a stand-alone software package, partly on the user's computer and partly on a remote computer or entirely on the remote computer. In the latter scenario, the remote computer may be connected to a user's computer through a bidirectional data communications network such as a local area network (LAN) or a wide area network (WAN), wireless data network e.g., Wi-Fi, Wimax, 802.xx, and/or a cellular network or the bidirectional connection may be made to an external computer via most third party supported networks (for example, through the Internet utilizing an Internet Service Provider).

The embodiments are described at least in part herein with reference to flowchart illustrations and/or block diagrams of methods, systems, and computer program products and data structures according to embodiments of the invention. It will be understood that each block of the illustrations, and combinations of blocks, can be implemented by computer program instructions. These computer program instructions may be provided to a processor of, for example, a general-purpose computer, special-purpose computer, or other programmable data processing apparatus to produce a machine, such that the instructions, which execute via the processor of the computer or other programmable data processing apparatus, create means for implementing the functions/acts specified in the block or blocks. To be clear, the disclosed embodiments can be implemented in the context of, for example a special-purpose computer or a general-purpose computer, or other programmable data processing apparatus or system. For example, in some embodiments, a data processing apparatus or system can be implemented as a combination of a special-purpose computer and a general-purpose computer.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the various block or blocks, flowcharts, and other architecture illustrated and described herein.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 8:
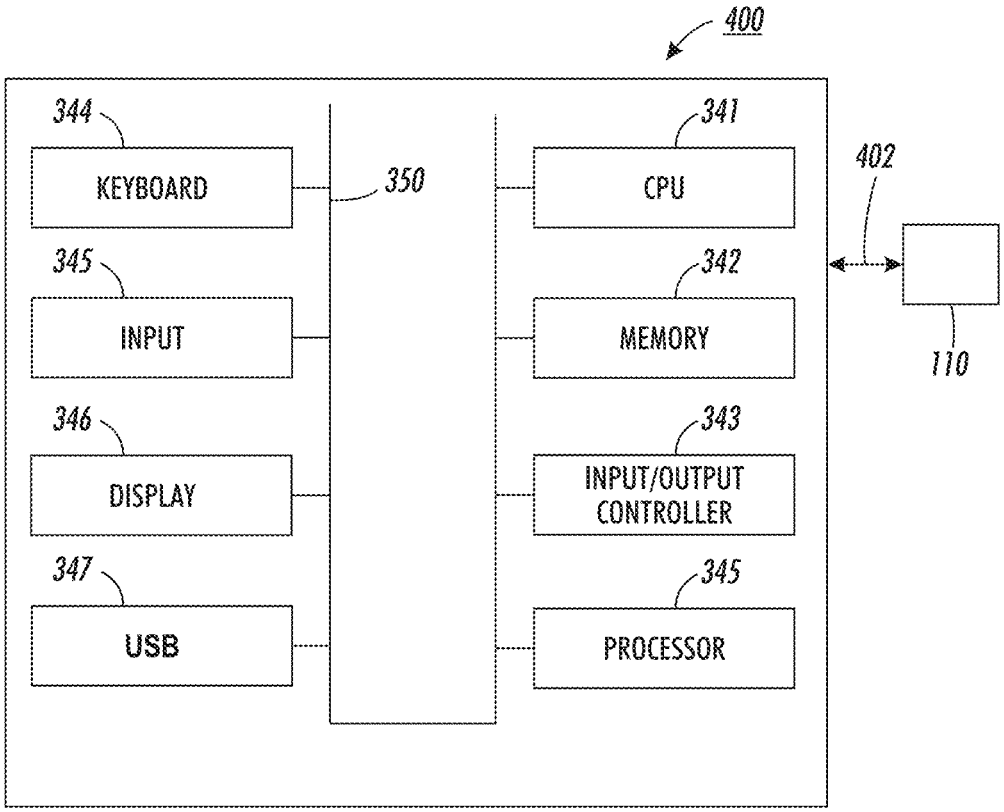
FIG. 8 illustrates a schematic view of a computer system, in accordance with an embodiment.
Figure 9:
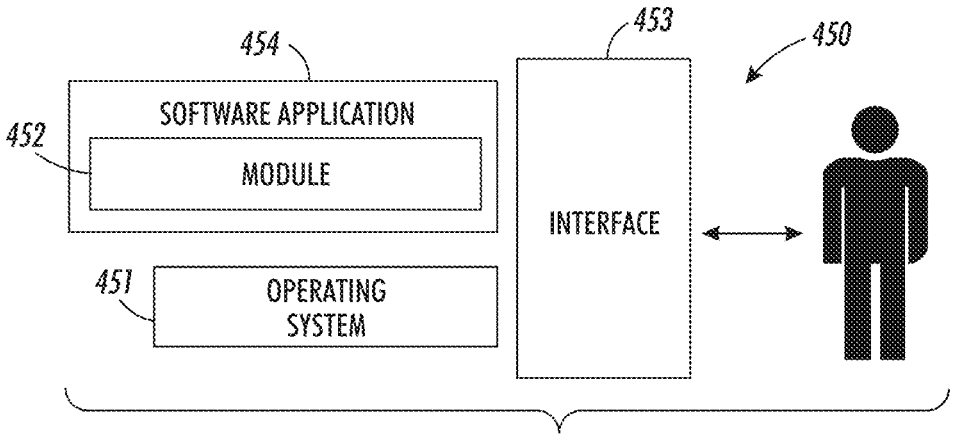
FIG. 9 illustrates a schematic view of a software system including a module, an operating system, and a user interface, in accordance with an embodiment.

FIGS. 8-9 are shown only as exemplary diagrams of data-processing environments in which example embodiments may be implemented. It should be appreciated that FIGS. 8-9 are only exemplary and are not intended to assert or imply any limitation with regard to the environments in which aspects or embodiments of the disclosed embodiments may be implemented. Many modifications to the depicted environments may be made without departing from the spirit and scope of the disclosed embodiments.

As illustrated in FIG. 8, some embodiments may be implemented in the context of a data-processing system 400 that can include, for example, one or more processors such as a CPU (Central Processing Unit) 341 and/or other another processor 349 (e.g., microprocessor, microcontroller etc), a memory 342, an input/output controller 343, a peripheral USB (Universal Serial Bus) connection 347, a keyboard 344 and/or another input device 345 (e.g., a pointing device, such as a mouse, track ball, pen device, etc.), a display 346 (e.g., a monitor, touch screen display, etc) and/or other peripheral connections and components. FIG. 8 is an example of a computing device that can be adapted for use in accordance with an embodiment.

As illustrated, the various components of data-processing system 400 can communicate electronically through a system bus 351 or similar architecture. The system bus 351 may be, for example, a subsystem that transfers data between, for example, computer components within data-processing system 400 or to and from other data-processing devices, components, computers, etc. The data-processing system 400 may be implemented in some embodiments as, for example, a server in a client-server based network (e.g., the Internet) or in the context of a client and a server (i.e., where aspects are practiced on the client and the server).

In some example embodiments, data-processing system 400 may be, for example, a standalone desktop computer, a laptop computer, a Smartphone, a pad computing device, a networked computer server, and so on, wherein each such device can be operably connected to and/or in communication with a client-server based network or other types of networks (e.g., cellular networks, Wi-Fi, etc). The data-processing system 400 can communicate with other devices such as, for example, the printing system 110. Communication between the data-processing system 400 and the printing system 110 can be bidirectional, as indicated by the double arrow 402. Such bidirectional communications may be facilitated by, for example, a computer network, including wireless bidirectional data communications networks.

FIG. 9 illustrates a computer software system 450 for directing the operation of the data-processing system 400 depicted in FIG. 8. Software application 454, stored for example in the memory 342 can generally include one or more modules such as module 452. The computer software system 450 also can include a kernel or operating system 451 and a shell or interface 453. One or more application programs, such as software application 454, may be "loaded" (i.e., transferred from, for example, mass storage or another memory location into the memory 342) for execution by the data-processing system 400. The data-processing system 400 can receive user commands and data through the interface 453; these inputs may then be acted upon by the data-processing system 400 in accordance with instructions from operating system 451 and/or software application 454. The interface 453 in some embodiments can serve to display results, whereupon a user 459 may supply additional inputs or terminate a session. The software application 454 can include module(s) 452, which can, for example, implement instructions or operations such as those discussed herein. Module 452 may also be composed of a group of modules and/or sub-modules.

The following discussion is intended to provide a brief, general description of suitable computing environments in which the system and method may be implemented. The disclosed embodiments can be described in the general context of computer-executable instructions, such as program modules, being executed by a single computer. In most instances, a "module" can constitute a software application, but can also be implemented as both software and hardware (i.e., a combination of software and hardware).

Generally, program modules include, but are not limited to, routines, subroutines, software applications, programs, objects, components, data structures, etc., that can perform particular tasks or which can implement particular data types and instructions. Moreover, those skilled in the art will appreciate that the disclosed method and system may be practiced with other computer system configurations, such as, for example, hand-held devices, multi-processor systems, data networks, microprocessor-based or programmable consumer electronics, networked PCs, minicomputers, mainframe computers, servers, and the like.

Note that the term module as utilized herein may refer to a collection of routines and data structures that perform a particular task or implements a particular data type. Modules may be composed of two parts: an interface, which lists the constants, data types, variable, and routines that can be accessed by other modules or routines, and an implementation, which may be private (e.g., accessible only to that module) and which can include source code that actually implements the routines in the module. The term module can also relate to an application, such as a computer program designed to assist in the performance of a specific task, such as word processing, accounting, inventory management, etc.

The nodule 452 may include instructions (e.g., steps or operations) for performing operations such as those discussed herein. For example, module 452 can provide instructions for operating the apparatus 60 shown in FIG. 6. Module 452 may also include instructions for implementing a method of ink contaminant drying. Such instructions may include steps or operations such as facilitating heating by a plurality of heating elements with respect to a surface of a marker platen having a topside and a bottom side, the plurality of heating elements located beneath the topside of the marker platen, wherein the plurality of heating elements provides the heating with respect to the surface of the marker platen, which assists in preventing ink contaminants on the surface from remaining in a viscous fluidic state over a period of time. Such instructions can further include steps or instructions such as operating the plurality of heating elements during a system idle time.

Based on the foregoing, it can be appreciated that a number of embodiments are disclosed herein. In one embodiment, an apparatus for ink contaminant drying can be implemented, which can include a marker platen having a topside and a bottom side; and a plurality of heating elements located beneath the topside of the marker platen, wherein the plurality of heating elements provides heating with respect to a surface of the marker platen, which assist in preventing ink contaminants on the surface from remaining in a viscous fluidic state over a period of time.

In an embodiment, the marker platen can include a plurality of platen guides, wherein each heating element among the plurality of heating elements may be respectively disposed within a platen guide of the plurality of platen guides. In another embodiment, the marker platen can further include a plurality of vacuum channels respectively formed from the plurality of platen guides. In still another embodiment, each vacuum channel among the plurality of vacuum channels can include a vacuum port. In another embodiment, a transport belt can be located above the plurality of platen guides.

In yet another embodiment, a printing system can be implemented in which the marker platen and the plurality of heating elements are located and operate. In such an embodiment, the transport belt may be located above the plurality of platen guides in the printing system. In still another embodiment, the marker platen can include a plurality of landing areas upon which a transport belt can ride.

In another embodiment, a printing system can provide ink contaminant drying. Such a printing system can include a marker platen having a topside and a bottom side. The marker platen can include a plurality of platen guides, and a plurality of heating elements located beneath the topside of the marker platen. The plurality of heating elements can provide heating with respect to a surface of the marker platen, which assists in preventing ink contaminants on the surface from remaining in a viscous fluidic state over a period of time.

In an embodiment of such a system, each heating element among the plurality of heating elements can be respectively disposed within a platen guide of the plurality of platen guides. In still another embodiment of such a system, the marker platen can further include a plurality of vacuum channels respectively formed from the plurality of platen guides. In still another embodiment of such a system, each vacuum channel among the plurality of vacuum channels can be configured to include a respective vacuum port. In an embodiment of the system, the transport belt may be located above the plurality of platen guides. In still another system embodiment, the marker platen can include a plurality of landing areas upon which the transport belt can ride.

In another embodiment, a method of ink contaminant drying can be implemented, which can include a step or operation of facilitating heating by a plurality of heating elements with respect to a surface of a marker platen having a topside and a bottom side. The plurality of heating elements can be located beneath the topside of the marker platen, such that the plurality of heating elements provides heating with respect to the surface of the marker platen, which assists in preventing ink contaminants on the surface from remaining in a viscous fluidic state over a period of time. In another embodiment of such a method, a step or operation can be provided for operating the plurality of heating elements during a system idle time.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. An apparatus for ink contaminant drying, comprising:

a marker transport belt and a marker platen, wherein the marker platen comprises a topside and a bottom side, the marker platen including platen guides and a plurality of vacuum channels formed from the platen guides, the marker transport belt configured with vacuum holes spaced periodically and aligned with the plurality of vacuum channels; and a plurality of heating elements located beneath the topside of the marker platen in the platen guides of the marker platen and in proximity to areas with a high probability of ink contamination, which results in an efficient transfer of energy for drying out ink contaminants, wherein the plurality of heating elements provides heating with respect to a surface of the marker platen, which assist in preventing ink contaminants on the surface from remaining in a viscous fluidic state over a period of time, and wherein the areas with the high probability of ink contamination include a contact area between the marker transport belt and the marker platen, the contact area comprising a region most likely to suffer from ink contamination, wherein each heating element among the plurality of heating elements comprises a cartridge heating element.

2. The apparatus of claim 1 wherein the platen guides of the marker platen comprise a plurality of topside platen guides, wherein each heating element among the plurality of heating elements is respectively disposed in a hollowed out region within each topside marker platen surface guide among the plurality of platen guides.

3. The apparatus of claim 2 wherein the marker platen is configured from stainless steel, wherein the stainless steel comprises a conductor of heat that transfers the heat to the ink contaminants as a part of the heating.

4. The apparatus of claim 2 wherein each vacuum channel among the plurality of vacuum channels includes a vacuum port.

5. The apparatus of claim 2 wherein the marker transport belt is located above the platen guides.

6. The apparatus of claim 2 further comprising a printing system in which the marker platen and the plurality of heating elements are located and operate.

7. The apparatus of claim 6 wherein the marker transport belt is located above the platen guides in the printing system.

8. The apparatus of claim 1 wherein the marker platen comprises a plurality of landing areas upon which the marker transport belt rides.

9. A printing system that provides ink contaminant drying, comprising:

a marker transport belt and a marker platen, wherein the marker platen comprises a topside and a bottom side, the marker platen including a plurality of platen guides and a plurality of vacuum channels formed from the plurality of platen guides, the marker transport belt configured with vacuum holes spaced periodically and aligned respectively with the plurality of vacuum channels; and a plurality of heating elements located beneath the topside of the marker platen in the plurality of platen guides of the marker platen and in proximity to areas with a high probability of ink contamination, which results in an efficient transfer of energy for drying out ink contaminants, wherein the plurality of heating elements provides heating with respect to a surface of the marker platen, which assist in preventing ink contaminants on the surface from remaining in a viscous fluidic state over a period of time, and wherein the areas with the high probability of ink contamination include a contact area between the marker transport belt and the marker platen, the contact area comprising a region most likely to suffer from ink contamination, wherein each heating element among the plurality of heating elements comprises a cartridge heating element.

10. The printing system of claim 9 wherein each heating element among the plurality of heating elements is respectively disposed in within a hollowed out region within a topside marker platen surface guide of the plurality of platen guides.

11. The printing system of claim 9 wherein the marker platen comprises stainless steel that comprises a conductor of heat that transfers the heat to the ink contaminants as a part of the heating.

12. The printing system of claim 9 wherein each vacuum channel among the plurality of vacuum channels includes a vacuum port.

13. The printing system of claim 12 wherein the marker transport belt is located above the plurality of platen guides.

14. The printing system of claim 13 wherein the marker platen comprises a plurality of landing areas upon which the transport belt rides.

15. A method for ink contaminant drying, comprising:

associating a marker transport belt with a marker platen having platen guides, a surface and a topside and a bottom side;

configuring the marker platen with a plurality of vacuum channels formed from the platen guides, the marker transport belt configured with vacuum holes spaced periodically and aligned with the plurality of vacuum channels;

locating a plurality of heating elements in the platen guides of the marker platen, wherein each heating element among the plurality of heating elements comprises a cartridge heating element; and facilitating heating by the plurality of heating elements with respect to the surface of the marker platen having the topside and the bottom side, the plurality of heating elements further located beneath the topside of the marker platen and in proximity to areas with a high probability of ink contamination, the heating resulting in an efficient transfer of energy for drying out ink contaminants, wherein the plurality of heating elements provides the heating with respect to the surface of the marker platen, which assists in preventing the ink contaminants on the surface from remaining in a viscous fluidic state over a period of time, and wherein the areas with the high probability of the ink contamination include a contact area between the marker transport belt and the marker platen, the contact area comprising a region most likely to suffer from the ink contamination.

16. The method of claim 15 wherein the platen guides include a plurality of topside platen guides, wherein each heating element among the plurality of heating elements is respectively disposed in a hollowed out region within each topside marker platen surface guide among the plurality of platen guides.

17. The method of claim 16 further comprising:

configuring the marker platen further with stainless steel comprising a conductor of heat that transfers the heat to the ink contaminants as a part of the heating; and forming a plurality of vacuum channels respectively from the plurality of platen guides; and configuring each vacuum channel among the plurality of vacuum channels to include a vacuum port.

18. The method of claim 16 further comprising locating the marker transport belt above the platen guides.

19. The method of claim 18 wherein the marker platen comprises a plurality of landing areas upon which the marker transport belt rides.

20. The method of 18 further comprising operating the plurality of heating elements during a system idle time in which a plurality of print heads are capped and printing does not take place.

* * * * *